US006190738B1

(12) United States Patent
Beck

(10) Patent No.: US 6,190,738 B1
(45) **Date of Patent: *Feb. 20, 2001**

(54) PROCESS FOR CLEANING A METAL CONTAINER PROVIDING ENHANCED MOBILITY

(75) Inventor: Leslie M. Beck, Concord, OH (US)

(73) Assignee: PPG Industries Ohio, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/287,777

(22) Filed: Apr. 7, 1999

(51) Int. Cl.[7] ..... B05D 1/38; B05D 3/10

(52) U.S. Cl. ..... 427/416; 427/327; 427/334; 427/443.2; 134/26; 134/41

(58) Field of Search ..... 427/327, 334, 427/416, 443.2; 134/41, 26

(56) References Cited

U.S. PATENT DOCUMENTS

| | | | | |
|---|---|---|---|---|
| 4,215,002 | | 7/1980 | Fein . | |
| 4,346,017 | * | 8/1982 | Cornelius, III | 252/321 |
| 4,363,740 | * | 12/1982 | Curtis et al. | 252/91 |
| 4,421,666 | * | 12/1983 | Hempel et al. | 252/140 |
| 4,590,237 | * | 5/1986 | Wuhrmann et al. | 524/480 |
| 4,599,116 | * | 7/1986 | King et al. | 134/2 |
| 4,859,351 | | 8/1989 | Awad . | |
| 4,859,889 | | 8/1989 | Andrews et al. . | |
| 4,944,889 | | 7/1990 | Awad . | |
| 5,030,323 | | 7/1991 | Awad . | |
| 5,061,389 | | 10/1991 | Reichgott . | |
| 5,064,500 | | 11/1991 | Awad . | |
| 5,080,814 | | 1/1992 | Awad . | |
| 5,179,083 | * | 1/1993 | Zody et al. | 514/54 |
| 5,254,344 | * | 10/1993 | Dookhith et al. | 424/405 |
| 5,286,300 | | 2/1994 | Hnatin et al. . | |
| 5,634,986 | * | 6/1997 | Beck | 148/246 |
| 5,746,837 | | 5/1998 | Beck et al. . | |

FOREIGN PATENT DOCUMENTS

94/01517 1/1994 (WO) .

* cited by examiner

*Primary Examiner*—Shrive Beck
*Assistant Examiner*—Michael Barr
(74) *Attorney, Agent, or Firm*—William J. Uhl; Deborah M. Altman

(57) ABSTRACT

Disclosed is a process for cleaning and applying a mobility enhancer to a metal container, preferably to an aluminum can, the process comprising the steps of: (a) contacting the container with an aqueous acidic prewashing solution; (b) contacting the container with an aqueous acidic or alkaline cleaning solution; (c) rinsing the container with an aqueous acidic dispersion (d) rinsing the container with an aqueous acidic dispersion comprised of a mobility enhancing composition, the mobility enhancing composition comprising (i) at least one wax; and (ii) at least one surfactant, in an amount sufficient to decrease the coefficient of static friction on the outside surface of the container, and to provide a substantially water-break-free surface thereon. Processes for cleaning and applying a mobility enhancer to a metal container wherein the mobility enhancing composition described above is applied to the container during a conditioning rinse or conversion coating step, or during one of several water rinsing steps are also disclosed. The mobility enhancing composition provides improved mobility of aluminum cans as they are conveyed along trackwork from the can washing operation to other remote operations in a can manufacturing facility without adversely affecting subsequently applied internal and/or external can coatings.

40 Claims, No Drawings

PROCESS FOR CLEANING A METAL CONTAINER PROVIDING ENHANCED MOBILITY

FIELD OF THE INVENTION

The present invention relates to a process for improving the mobility of metal containers as they move along a conveyor or trackwork without adversely affecting the adhesion of subsequently applied coatings. The invention is particularly suitable for improving the mobility of aluminum cans that are washed subsequent to their formation. The improved mobility enhances the movement of the cans as they are conveyed at high speeds from the wash process areas of the manufacturing facility to other areas for further processing, i.e., coating, printing, lacquering, etc.

BACKGROUND OF THE INVENTION

Metal containers, particularly aluminum cans, are commonly used as containers for a wide variety of products. After their manufacture, the cans are typically washed with acidic or alkaline cleaners to remove aluminum fines, forming lubricants, and other contaminants. A clean and stain-free aluminum surface is essential to the proper application of inks and other coatings. One undesirable result of the aforementioned cleaning process is that water often is retained on the clean, rinsed metal can surfaces. This represents a major heat load for a dry off oven. A water load reduction is desirable because such a reduction reduces energy requirements and provides faster drying times resulting in an increased production rate, and allowing for the use of thinner gauge aluminum.

It is also desirable that the aluminum cans move smoothly through the conveyor system and onto or off the printer mandrels during the manufacturing process. The term "mobility" is used in the industry to refer to the ability of aluminum cans to travel unimpeded (i.e. sliding smoothly against one another) through the manufacturing process conducted at the highest line speed possible. Cans characterized as having poor "mobility" generally have higher coefficients of static friction.

Thoroughly cleaned aluminum cans, however, are typically characterized by high surface roughness, resulting in a high coefficient of static friction, typically about 1.6. This property hinders the mobility of cans through single filers and printers when attempting to increase line speed. This can result in production losses due to frequent jamming, printer misfeeding problems, and a high rate of can rejects.

Periodically during the can manufacturing process, there are, for various reasons, line stoppages. During such a stoppage, a portion of the cans in the washing cycle can be halted in the dry off ovens where temperatures are sufficiently high to volatilize some of the conventional mobility enhancers from the outer surfaces of the cleaned cans. This can result in a portion of the cleaned cans having increased coefficient of static friction values and, hence, poor mobility.

Thus, a need has arisen in the aluminum can manufacturing industry to modify the coefficient of static friction on the outside surface of the cans to improve their mobility without adversely affecting the subsequent application of printing inks and other coatings. Moreover, the material used to promote enhanced mobility must be oven-stable, that is, it must not volatilize at temperatures encountered in the dry-off ovens. Increased production demands are prompting can manufacturers to increase line and printer speeds to produce more cans per unit time. Thus, improving the mobility of aluminum cans is the general trend in the industry.

U.S. Pat. No. 4,599,116 describes an alkaline cleaning process for aluminum container surfaces. The aqueous alkaline cleaning composition contains an alkalinity agent, a complexing agent to chelate at least some of the metal ions removed from the metal surface by the cleaning solution, and at least one surfactant to remove organic soils from the surfaces of the container and to inhibit white-etch staining of the surfaces. The reference indicates that following cleaning a mobility enhancing conversion coating can be applied to the surface of the can for improving the ability of the cans to move throughout the trackwork.

U.S. Pat Nos. 4,859,351; 4,944,889; 5,030,323; 5,064,500; and 5,080,814 describe lubricant and surface conditioners for application to aluminum cans. These patents indicate that the disclosed compositions reduce the coefficient of static friction on the outside surface of the cans which enhances mobility, thereby permitting an increase in production line speed. The lubricant and surface conditioners disclosed in these patents are water-soluble alkoxylated surfactants, namely, organic phosphate esters; alcohols; fatty acids including mono-, di-, tri-, and poly-acids; fatty acid derivatives such as salts, hydroxy acids, amides, esters, ethers and derivatives thereof and mixtures thereof. The references state that the lubricant and surface conditioner may be applied to the cans during the wash cycle, during one of the treatment cycles, during one of the rinse cycles or after the final water rinse. Both acidic and alkaline wash cycles are disclosed.

U.S. Pat. No. 5,061,389 discloses a composition and process for reducing the coefficient of friction on the surface of formed metal structures, such as aluminum cans, by lubricating the surface with a blend of a polyethylene glycol ester and a fluoride compound.

U.S. Pat. No. 5,286,300 discloses a process and a composition useful as a rinse aid for metal surfaces and for improving mobility of formed metal surfaces comprised of a nonionic polyoxyalkylene glycol and an alkoxy derivative of a nonionic ethoxylated and propoxylated glycol. The reference indicates that the process results in an improvement in the drainage of water from metal surfaces and a reduction in the coefficient of friction of the metal surfaces for improved mobility.

U.S. Pat. No. 5,634,986 discloses a process for improving the mobility of formed metal surfaces and for reducing the metal exposure rating of the surfaces which are subsequently coated. Specifically, the reference teaches contacting the metal surfaces with an aqueous composition comprised of a polyethylene to provide improved mobility and a reduction in metal exposure ratings of subsequently coated metal surfaces. It has been found, however, that use of this process brings about an adverse effect on adhesion of a subsequently applied pigmented basecoat.

U.S. Pat. No. 5,746,837 discloses an aqueous composition for enhancing the mobility of an aluminum can that is transported along a conveyor or trackwork, the composition comprising a carboxylic acid or acid-producing compound with ammonia, an amine or an alkali or alkaline earth metal. The reference also discloses a process for mobility enhancement by applying the aforementioned composition to the outer surfaces of an aluminum can during various stages of the can cleaning process. Additionally, the reference teaches that aqueous compositions of the invention also permit a reduction in can drying temperatures.

Although each of the aforementioned compositions and processes provides improved mobility of formed metal substrates, particularly aluminum cans, the increased demands for faster line speeds and increased production mandates an even further reduction in the coefficient of static friction of cleaned metal cans. Also, the compositions disclosed in the references may not be sufficiently oven-stable, that is, they may volatilize in the dry-off oven during a line stoppage and, consequently, exhibit poor mobility.

The use of various waxes, such as branched hydrocarbon waxes, carnauba waxes and the like, for improving storage stability of aqueous-based metallic surface coatings is well known in the art. Also, the use of these waxes in metal container coatings, for example, varnish and basecoat compositions, is known to enhance mobility of the coated containers as they are conveyed through trackwork in the manufacturing facilities, as well as in beverage filling lines. The application of such waxes in metal container washing processes as mobility enhancers, however, is not known.

It has been found that the addition of a mobility enhancing composition comprising one or more particular waxes in combination with at least one surfactant to disperse the wax in aqueous media provides a notable improvement in the reduction of the coefficient of static friction of cleaned metal containers, thereby improving mobility of the cans as they are conveyed along trackwork in a manufacturing facility. Such mobility enhancing compositions are dry off oven stable and provide a substantially water-break-free metal surface.

SUMMARY OF THE INVENTION

In accordance with the present invention, provided is a process for cleaning and applying a mobility enhancer to a metal container comprised of the steps of (a) contacting the container with an aqueous acidic prewashing solution; (b) contacting the container with an aqueous acidic or alkaline cleaning solution; (c) rinsing the container with an aqueous acidic composition; (d) rinsing the container with an aqueous acidic dispersion comprising a mobility enhancing composition, the mobility enhancing composition comprising (i) at least one wax, and (ii) at least one surfactant in an amount sufficient to decrease the coefficient of static friction on the outside surface of the container to 1 or less and to provide a substantially water break free surface thereto; (e) rinsing the metal container with tap and/or de-ionized water; (f) drying the container; and (g) conveying the container along a conveyor or trackwork Also provided is a process for cleaning and applying a mobility enhancer to a metal container wherein the container is contacted with a conditioning rinse composition or a conversion coating composition comprised of the mobility enhancing composition described above. Additionally provided is a process for cleaning and applying a mobility enhancer to a metal container wherein the mobility enhancing composition described above is employed in any of the various water rinse steps.

Other than in the operating examples, or where otherwise indicated, all numbers expressing quantities of ingredients or reaction conditions used in the specification and in the claims are to be understood as being modified in all instances by the term "about".

DETAILED DESCRIPTION OF THE INVENTION

As aforementioned, the present invention relates to a process for cleaning and applying a mobility enhancer to a metal container, preferably to an aluminum can. Typically, aluminum can washing operations employ six sequential wash or rinse stages: (1) prewash; (2) acid or alkaline cleaner; (3) rinse, most often an acidic rinse; (4) condition rinse or treatment; (5) rinse, most often a tap water rinse; and (6) de-ionized water rinse. These wash or rinse stages will be described in greater detail below. In the processes of the invention, the mobility enhancer can be incorporated into any of stages (2) to (6), stages (3) to (6), and more preferably stage (4).

In the above-described preferred embodiment, the mobility enhancer is incorporated into the fourth stage rinse, that is, step (d), as an aqueous acidic dispersion comprised of a mobility enhancing composition, the mobility enhancing composition comprising (i) at least one wax and (ii) at least one surfactant, the mobility enhancing composition being present in an amount sufficient to reduce the coefficient of static friction on the outside surface of the container to 1 or less, preferably 0.6 or less and more preferably to 0.4 or less, and to provide a substantially water-break-free surface.

A "substantially water-break-free surface" is achieved when the rinse water "sheets off" leaving a continuous thin layer of water after rinsing. This represents a surface that is free of lubricants or oils.

In another preferred embodiment of the invention, after the third stage rinse but prior to step of rinsing with tap or de-ionized water, the process further comprises a step of contacting the container with a conditioning rinse composition or a conversion coating composition comprising the mobility enhancing composition described above which is present in an amount sufficient to reduce the coefficient of static friction to 1 or less, preferably 0.6 or less, and more preferably 0.4 or less, and to provide a substantially water-break-free surface. The conditioning rinse composition and the conversion coating composition are described in detail below.

As used herein the term "wax" is meant to include natural waxes such as petroleum waxes, e.g., paraffin wax and microcrystalline paraffin waxes; mineral waxes, e.g., montan wax; and vegetable waxes, e.g., carnauba wax and microcrystalline carnauba waxes; and to exclude synthetic waxes such as Fischer-Tropsch waxes and polyethylene waxes. Microcrystalline waxes are generally solid hydrocarbon mixtures which are typically $C_{35}$ to $C_{60}$ branched-chain hydrocarbons and alkylcycloaliphatic hydrocarbons as well as some straight-chain molecules. These waxes are referred to as "microcrystalline" because of their relatively small crystal size which gives an amorphous appearance to the waxes in the solid state.

Preferably, the wax component (i) is selected from the group consisting of carnauba wax, microcrystalline carnauba wax, paraffin wax and mixtures thereof. In a preferred embodiment of the invention, the wax component (i) is comprised of a mixture of carnauba and microcrystalline carnauba waxes. In a preferred embodiment of the invention, the wax component (i) is comprised of a mixture of carnauba and paraffin waxes. In yet another preferred embodiment of the invention, the wax component (i) is comprised of paraffin wax and an oxidized ethylene homopolymer having a weight average molecular weight of from 1000 to 10,000 as determined by gel permeation chromatography using a polystyrene standard and an acid number of from 5 to 55 as determined by a standardized titration of KOH.

Paraffin waxes are natural, petroleum-based waxes which are solid, firm materials that are typically mixtures of saturated straight-chain hydrocarbons obtained from refining waxy distillates derived from paraffinic crude oils. Examples of paraffin waxes suitable for use in the mobility enhancing compositions of the present invention are those commercially available as MICHEM LUBE 723 from Michelman Inc.

Carnauba waxes are natural, vegetable-based waxes which typically comprise a mixture of esters of fatty acids and high-molecular weight alcohols and unsaponifiable materials. Examples of carnauba waxes suitable for use in the mobility enhancing compositions of the present invention are those commercially available as CHEMCOR AS35-3 from Chemcor, Inc. Examples of microcrystalline carnauba waxes suitable for use in the mobility enhancing compositions of the invention are those commercially available from Michelman, Inc. under the trade name MICHEM-LUBE.

When the mobility enhancing composition is employed in step (d), i.e., the fourth stage rinse, the wax component (i) is present in the aqueous acidic dispersion in an amount typically less than and up to 10,000 parts per million, preferably less than and up to 8000 parts per million, and most preferably less than and up to 5000 parts per million, based on total weight of the aqueous acidic dispersion. The level of the wax component (i) in the aqueous dispersion may range between any combination of these values, inclusive of the recited values, for example, in an amount from about 5 parts per million to 10,000 parts per million based on the total weight of the aqueous acidic dispersion.

As aforementioned, the mobility enhancing compositions of the invention can further comprise an oxidized ethylene homopolymer, that is, an oxidized polyethylene. Suitable oxidized polyethylenes can be low or high-density polyethylenes which typically contain up to 9% by weight of oxygen. The oxidized ethylene homopolymers suitable for use in the present invention typically have a density at 23° C., as determined by ASTM D-1505, ranging from 0.85 to 1.05 g./cc.

Generally, the oxidized ethylene homopolymers which are useful in the mobility enhancing compositions of the invention are prepared by oxidizing polyethylenes with air or oxygen by conventional procedures. Suitable methods are described in U.S. Pat. Nos. 3,060,163; 3,222,711; 3,917,893; and 4,129,507. Examples of suitable oxidized ethylene homopolymers also include those commercially available from Allied Signal Corporation under the tradename designation A-C® polyethylene, for example, A-C® 316, 325, and 392 identified as low molecular weight, high density oxidized polyethylenes, and A-C® 329, 655, and 680 identified as low molecular weight, high density oxidized polyethylenes. Suitable oxidized ethylene homopolymers are commercially available from various other sources, for example, from BASF Corporation under the general trade designation LUWAX and from Petrolite Corporation, Petrolite Polymers Division, as PETROLITE E-1040.

When employed in the wax component (i) of the mobility enhancing compositions of the invention, the oxidized ethylene homopolymer is typically present in the working solution in an amount ranging from 1 to 5000 parts per million, preferably from 1 to 1000 parts per million and more preferably from 1 to 10 parts per million, based on total weight of the mobility enhancing composition.

It should be appreciated that when the oxidized ethylene homopolymer is employed in the wax component (i), the wax and the oxidized ethylene homopolymer may each be added as a separate component, or, alternatively, the oxidized ethylene homopolymer and the wax may be pre-emulsified prior to dispersion into aqueous media. Exemplary of a suitable paraffin/oxidized polyethylene emulsion is EM-12, commercially available from Chemcor, Inc.

Likewise, when the wax component (i) is comprised of two or more waxes, each of the waxes may be added as a separate component, or, alternatively, the waxes may be pre-blended or pre-emulsified and added as a single component prior to dispersion into aqueous media. Exemplary of a suitable carnauba/paraffin emulsion is MICHEM LUBE 182 commercially available from Michelman Inc. Exemplary of a suitable paraffin/polyethylene emulsion is CHEMCOR EMULSION 12, commercially available from Chemcor, Inc.

The mobility enhancing compositions employed in the processes of the present invention further comprise (ii) at least one surfactant, selected from the group consisting of anionic surfactants, nonionic surfactants, cationic surfactants and mixtures thereof. Anionic surfactants are preferred. The surfactant component (ii) acts to uniformly disperse and stabilize the wax component (i) in aqueous media.

Examples of anionic surfactants suitable for use as the surfactant component (ii) in the mobility enhancing composition of the invention include, but are not limited to, sulfates or sulfonates. Specific examples include higher alkyl mononuclear aromatic sulfonates such a the higher alkyl benzene sulfonates containing from 10 to 16 carbon atoms in the alkyl group and a straight- or branched-chain, e.g., the sodium salts of decyl, undecyl, dodecyl, tridecyl, tetradecyl, pentadecyl or hexadecyl benzene sulfonate and the higher alkyl toluene, xylene and phenol sulfonates; alkyl naphthalene sulfonate, and sodium dinonyl naphthalene sulfonate.

Other suitable anionic surfactants include olefin sulfonates, including long chain alkene sulfonates, long chain hydroxyalkane sulfonates or mixtures thereof. These olefin sulfonate detergents may be prepared, in known manner, by the reaction of $SO_3$ with long chain olefins having 8–25 carbon atoms. Examples of other sulfate or sulfonate detergents are paraffin sulfonates, such as the reaction products of alpha olefins and bisulfites (e.g., sodium bisulfite). These include primary paraffin sulfonates of 10–20 carbon atoms; sulfates of higher alcohols; and salts of alpha-sulfofatty ester (e.g., methyl α-sulfomyristate or α-sulfotallate). Also included are sulfates of higher alcohols such as sodium lauryl sulfate, sodium tallow alcohol sulfate, or sulfates of mono- or di-glycerides of fatty acids (e.g. stearic monoglyceride monosulfate), alkyl poly(ethoxy) ether sulfates such as the sulfates of the condensation products of ethylene oxide and lauryl alcohol (usually having 1–5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1–20 oxyethylene groups per molecule).

Examples of other suitable anionic surfactants are salts of sulfated aliphatic alcohol, alkyl ether sulfate and/or alkyl aryl ethoxy sulfate available from Rhone-Poulenc under the general trade name ABEX.

Also, suitable anionic surfactants may be of the phosphate mono- or diester type. These anionic surfactants are well known and are commercially available under the general trade designation GAFAC from the GAF Corporation, and under the general trade designation TRITON from Rohm & Haas Company.

Examples of nonionic surfactants suitable for use as the surfactant component (ii) in the mobility enhancing composition of the invention include, but are not limited to, those containing ether linkages and which are represented by the following general formula: $RO(R'O)_nH$, where R is a hydrocarbon group containing from 6 to 60 carbon atoms, R' is an alkylene group containing 2 or 3 carbon atoms, or mixtures thereof, and n is an integer ranging from 2 to 100. Such nonionic surfactants are generally prepared by treating fatty alcohols or alkyl-substituted phenols with an excess of ethylene or propylene oxide. The alkyl carbon chain may contain from 14 to 40 carbon atoms and may be derived from a long chain fatty alcohol such as oleyl alcohol or stearyl alcohol. Nonionic polyoxyethylene surfactants of the type represented by the formula above are commercially available under the general trade designation SURFYNOL from Air Products Chemicals, Inc., PLURONIC or TETRONIC from BASF Corporation; TERGITOL from Union Carbide; and SURFONIC from Huntsman Corporation.

Other suitable nonionic surfactants include block copolymers of ethylene oxide and propylene oxide based on a glycol such as ethylene glycol or propylene glycol. The copolymers based on ethylene glycol generally are prepared by forming a hydrophilic base by reaction of ethylene oxide with ethylene glycol followed by condensation of this intermediate product with propylene oxide. The copolymers based on propylene glycol similarly are prepared by reacting propylene oxide with propylene glycol to form the intermediate which is then condensed with ethylene oxide. By varying the proportions of ethylene oxide and propylene oxide used to form the above copolymers, the properties may be varied. Both of the above-described copolymers are available commercially from BASF Corporation under the general trade designation PLURONIC.

As indicated above, cationic surfactants may also be used. Examples of cationic surfactants suitable for use as the surfactant component (ii) in the mobility enhancing composition of the invention include, but are not limited to, acid salts of alkyl amines such as ARMAC HT, an acetic acid salt of n-alkyl amine available from Akzo Nobel Chemicals; imidazoline derivatives such as CALGENE C-100 available from Calgene Chemical Inc.; ethoxylated amines or amides such as DETHOX Amine C-5, a cocoamine ethoxylate available from Deforest Enterprises; ethoxylated fatty amines such as ETHOX TAM available from Ethox Chemicals Inc.; and glyceryl esters such as LEXEMUL AR, a glyceryl stearate/stearamidoethyl diethylamine available from Inolex Chemical Co.

When the mobility enhancing composition is employed in step (d), i.e., the fourth stage rinse, the surfactant component (ii) is present in the aqueous acidic dispersion in an amount typically less than and up to 2000 parts per million, preferably less than and up to 700 parts per million, and most preferably less than and up to 500 parts per million, based on total weight of the aqueous acidic dispersion. The level of the surfactant component (ii) in the aqueous dispersion may range between any combination of these values, inclusive of the recited values, for example, in an amount of from 10 parts per million to 2000 parts per million based on total weight of the aqueous acidic dispersion.

In another preferred embodiment of the invention, the process for cleaning and applying a mobility enhancer to a metal container, preferably an aluminum can, comprises the steps of (a) contacting the container with an aqueous acidic prewashing solution; (b) contacting the container with an aqueous acidic or alkaline cleaning solution; (c) rinsing the container with an aqueous acidic composition; (d) contacting the container with a conditioning rinse composition or a conversion coating composition comprising the mobility enhancing composition as described above in an amount sufficient to decrease the coefficient of static friction on the outside surface of the container to 1 or less, and to provide a substantially water-break-free surface; (e) rinsing the container with an aqueous acidic composition; (f) rinsing the container with tap water and/or de-ionized water; (g) drying the container; and (h) conveying the container along a conveyor or trackwork.

When the mobility enhancing composition is employed in the conditioning or conversion stage, the wax component (i) is present in the conditioning rinse or in the conversion coating composition in an amount typically less than and up to 10,000 parts per million, preferably less than and up to 8,000 parts per million, and most preferably less than and up to 3000 parts per million, based on total weight of the conditioning rinse or conversion coating composition. The level of the wax component (i) in the conditioning rinse or conversion coating composition may range between any combination of these values, inclusive of the recited values, for example, in an amount of from 5 parts per million to 2000 parts per million based on total weight of the conditioning rinse or conversion coating composition.

The surfactant component (ii) is present in the conditioning rinse or in the conversion coating composition in an amount typically less than and up to 2000 parts per million, preferably less than and up to 700 parts per million, and most preferably less than and up to 500 parts per million, based on total weight of the conditioning rinse or conversion coating composition. The level of the surfactant component (ii) in the conditioning rinse or conversion coating composition may range between any combination of these values, inclusive of the recited values, for example, in an amount of from 5 parts per million to 2000 parts per million based on total weight of the conditioning rinse or conversion coating composition.

In another preferred embodiment of the invention, the process for cleaning and applying a mobility enhancer to a metal container, preferably an aluminum can, comprises the steps of (a) contacting the container with an aqueous acidic or alkaline prewashing solution; (b) contacting the container with an aqueous acidic or alkaline cleaning solution; (c) rinsing the container with an aqueous acidic composition; (d) contacting the container with a conditioning rinse composition or a conversion coating composition; (e) rinsing the container with an aqueous acidic dispersion; (f) rinsing the container with an aqueous dispersion comprising a mobility enhancing composition, the mobility enhancing composition comprising the following components: (i) at least one wax as described above; (ii) at least one surfactant as described above; and (iii) tap water and/or de-ionized water; (g) drying the container; and (h) conveying the container along a conveyor or trackwork.

When the mobility enhancing composition is employed in the final rinse stage (e), that is, the stage 6 rinse, the wax component (i) is present in the aqueous dispersion in an amount typically less than and up to 5000 parts per million, preferably less than and up to 3000 parts per million, and most preferably less than and up to 1000 parts per million, based on total weight of the aqueous dispersion. The level of the wax component (i) in the aqueous dispersion may range between any combination of these values, inclusive of the recited values, for example, in an amount of from 5 parts per million to 5000 parts per million based on total weight of the aqueous dispersion.

The surfactant component (ii) is present in the aqueous dispersion in an amount typically less than and up to 2000 parts per million, preferably less than and up to 700 parts per million, and most preferably less than and up to 500 parts per million, based on total weight of the aqueous dispersion. The level of the surfactant component (ii) in the aqueous dispersion may range between any combination of these values, inclusive of the recited values, for example, in an amount of from 10 parts per million to 2000 parts per million based on total weight of the aqueous dispersion.

The mobility enhancing composition can be incorporated directly into any one of the various wash or rinse stages as used on metal sheets, roll stock, or coil stock and aluminum cans. Additionally, the mobility enhancing composition can be added directly to the wash or rinse bath or treatment composition. Alternatively, the mobility enhancing composition can be initially mixed with water to form a concentrate which then can be added to the wash or rinse bath or treatment, to the concentrates of the acid or alkaline cleaners, or to the conditioning rinse solutions or conversion coating compositions.

Additionally, adjuvant ingredients may be included in the wash or rinse stages and incorporated as described above for the incorporation of the mobility enhancing composition. For example, one or more adjuvant surfactants, (such as those described above), antimicrobial agents or biocidal agents, or defoamers may be added.

Any antimicrobial or biocidal agent, except those having a detrimental affect on mobility enhancing properties or stability of the various wash or rinse baths or treatments may be used. These antimicrobial or biocidal agents are typically added in an amount sufficient to effectively inhibit the growth of microorganisms. Hydrogen peroxide and/or ammonium bifluoride or chlorine are particularly useful for this purpose. The wash or rinse bath or treatment compositions employed in the processes of the inventor typically contain up to 2 percent by weight of hydrogen peroxide or ammonium.

Any defoamer, except those which negatively affect mobility enhancing properties or those which induce metal exposure, may be incorporated as described above for incorporation of the mobility enhancing properties or those which induce metal exposure, may be incorporated as described above for incorporation of the mobility enhancing composition. The wash or rinse bath or treatment compositions employed in the processes of the invention typically can contain up to 2 percent by weight of defoamer.

ALUMINUM CAN WASHING PROCESS:

The can washing process in which the mobility enhancing composition described above is utilized can be any process adapted for washing aluminum cans. Typically, the cans, which are conveyed from a drawed and ironed (D&I) forming process, are contaminated with oils, aluminum fines, and other contaminants. These contaminants must be removed before the cans are printed, painted or lacquered. Also, as indicated above, chemical conversion coatings can be deposited on the cans during the wash process to promote adhesion of subsequently applied printing inks, paints lacquers and the like, improve mobility, prevent dome discoloration which can occur during the pasteurization of container contents, and/or enhance corrosion resistance. A conditioning rinse may be applied to improve cleanliness.

As aforementioned, aluminum can washing operations generally employ six sequential wash or rinse stages. During each stage, a bath containing the desired wash or rinse composition is employed. The cans are "contacted" with these wash or rinse compositions by application techniques commonly known in the art, such as by flooding, immersion and, as is preferred, by spraying. Following the final rinse stage 6, the cans are dried and then conveyed to a work station remote from the washing operation wherein they are further processed, e.g., printed, painted, lacquered, etc.

As indicated above the mobility enhancing composition comprising at least one wax and at least one surfactant can be applied to the containers during one or more of stages 2 to 6, preferably during stages 3 to 6, and more preferably during stage 4. Those skilled in the art will recognize that, in some instances, one or more stages can be merged into one stage, or additional treatment stages can be added. When such modifications are employed, it will be understood that the mobility enhancing composition of the invention can be applied to the surface of the can during any stage from the cleaning stage 2 to just prior to the drying step.

Mobility enhancing compositions can be, and often are, employed in the stage 6 de-ionized water rinse which is described in detail below. However, the use of these materials in this stage requires the removal of the carbon filter present in the line to filter organic impurities and micro organisms to prevent fouling of the ion exchange column. It is, therefore, desirable that the mobility enhancing composition of the invention be employed in one of the earlier stages of the can washing process.

The prewash stage (stage 1) is used to remove heavy accumulations of oil and aluminum fines from the can surface before entering the acid or alkaline cleaning stage (stage 2). The prewash is typically operated at a temperature ranging from 60° F. to 150° F., preferably from 80° F. to 130° F., and more preferably from 110° F. to 120° F., at a pH ranging from 2 to 5, preferably 2.5 to 3.5. The cans are typically sprayed for 10 to 60 seconds, preferably 20 to 40 seconds, and more preferably 30 seconds.

The cleaning stage (stage 2) is used to remove the balance of the organic and inorganic soils remaining on the can surface after the prewash. Either an aqueous acidic or alkaline cleaning solution can be used. The organic soils can include water-soluble lubricants from bodymaker operations, rolling oils, and general shop dirt. The inorganics can include aluminum fines and natural oxide or corrosion.

The aqueous acidic cleaning solutions used during stage 2 cleaning generally comprise at least one inorganic acid. Examples of suitable inorganic acids include sulfuric acid, the hydrohalic acids and mixtures thereof. Hydrofluoric acid is a particularly useful hydrohalic acid. Also, a source of fluorine ions, e.g. ammonium bifluoride, can be used as an alternative to hydrofluoric acid. Mixtures of sulfuric acid and hydrofluoric acid can also be used. Preferably, sulfuric acid is employed in the acidic cleaning solution at a concentration sufficient to maintain the pH between 0.5 and 6, preferably 0.5 to 2.5. Concentrations of sulfuric acid typically range from 0.04 to 60 grams/liter.

The aqueous alkaline cleaning solutions used during this stage typically comprise at least one inorganic base and, optionally at least one complexing agent. The base is provided in an amount sufficient to achieve satisfactory removal of aluminum fines from the container surfaces while not unduly etching the aluminum surface so as to provide a bright, reflective surface. The complexing agent is provided in an amount sufficient to complex at least some of the metal ions in the operating bath which tend to form undesirable precipitates.

The inorganic base may comprise any one or a combination of bath soluble compounds including alkali or alkaline earth metal borates, carbonates, hydroxides, phosphates and the like. Alkali metal hydroxides and alkali metal carbonates are preferred. A mixture of sodium hydroxide and sodium carbonate can also be used. The inorganic base is present in a concentration sufficient to provide an operating pH ranging from 8 to 13, preferably 10 to 13. In order to provide the requisite alkalinity, the inorganic base is typically employed at a concentration of 0.05 to 10 grams/liter.

The complexing agent may comprise any one or a combination of bath-soluble compounds which are effective to complex at least some of the metal ions present in the bath to avoid the formation of deleterious precipitates. Sugar acids as well as salts thereof are particularly useful for this purpose. Examples of suitable complexing agents include gluconic acid, citric acid, glucoheptanoic acid, sodium tripolyphosphate, EDTA, tartaric acid or the like, as well as salts thereof. Generally, the concentration of the complexing agent in the operating bath is controlled within a range of 0.01 to 5 grams/liter.

The aqueous acidic and alkaline cleaning solutions further comprise at least one, typically two, surfactants to effect the removal of lubricants and organic soils such as those encountered in the can forming process. Combinations of anionic and nonionic surfactants such as those described above are particularly useful for this purpose. These surfactants are typically present in the aqueous acidic and alkaline cleaning solutions in an amount sufficient to provide a substantially oil-free surface. The concentration of the surfactant in the cleaning solutions typically ranges from 0.003 to 5 grams/liter.

The aqueous acidic or alkaline cleaning solutions are applied to the can surface at comparatively low to moderate temperatures typically below 150° F. to ambient (i.e., about 60° F.), preferably within the range of 90° F. to 130° F. The "contacting" of the can may be effected by flooding, immersion or, as is preferred, by spraying. The cans are sprayed with the cleaning solution for 10 to 50 seconds, preferably 20 to 30 seconds. The cleaning solution is replenished by use of a concentrate of the above-described constituents in the appropriate proportions. The concentrate may be in solid form, but preferably is in the form of an aqueous concentrate containing from 50% to 90% by weight water with the balance comprising the active ingredients present in the same proportions as the final diluted operating bath.

The purpose of the rinse in stage 3 is to completely remove all acidic or alkaline cleaner and any remaining soils from the can surface prior to subsequent treatment. In order to conserve water and to obtain the maximum benefit from the amount of water used, a two-stage counterflowed rinse can be used. After the cleaning stage blow-off, some washers use a spray rinse directed on the cans. This rinse can be followed by a blow-off and is commonly called a "drag-out rinse". A recirculated water rinse can be used in stage 3. This recirculated rinse can be supplied as fresh water or, in many instances, by counterflowed water from stage 5. Spray pressures are regulated so as to balance input and output to the drag-out rinse with a maximum of overflow of the tank used in stage 3. Typically, tap or city water is used as the rinse water and an effective amount of sulfuric acid is added to provide a pH in the range of 1.5 to 3, preferably 1.9 to 2.1. The rinse temperature can range from 70° F. to 150° F., preferably from 90° F. to 120° F. The cans are sprayed for 1 to 60 seconds, preferably from 5 to 20 seconds and more preferably for about 15 seconds.

A conditioning rinse or a conversion coating can be applied in stage 4. As aforementioned, the conditioning rinse, when applied, promotes cleanliness of the can surface. Typically, the conditioning rinse is an aqueous composition containing sulfuric acid, hydrofluoric acid and boric acid.

As indicated above, the conversion coating, when applied, is used to enhance can transport mobility, to protect against exterior dome staining which can occur during pasteurization processes, to provide corrosion resistance and promote adhesion of subsequently applied organic coatings such as inks, paints lacquers and the like. Typically the conversion coating composition is applied to at least part of the exterior surface of the can and may be any one that is conventionally available including, for example, , titanium zirconium or hafnium, with or without tannin. Exemplary of such conversion coating solutions and processes are those described in U.S. Pat. Nos. 4,017,334; 4,054,466; and 4,338,140.

Generally, the stage 4 conversion coating bath has a pH in the range of 1 to 4, preferably 1.8 to 3.0 and a temperature ranging from 60° F. to 150° F., preferably from 90° F. to 150° F., and more preferably from 100° F. to 130° F. The cans are typically sprayed with the conversion coating solutions for 1 to 60 seconds, preferably from 5 to 20 seconds and more preferably for about 10 seconds.

The stage 4 conditioning bath has a pH in the range of 2 to 8, preferably 4 to 6 and is preferably operated at ambient temperature, that is, without the addition of heat. The cans are sprayed for 1 to 60 seconds, preferably from 5 to 20 seconds and more preferably for about 10 seconds. The purpose of the stage 5 rinse is to remove all residual conditioning rinse or conversion coating chemicals from the can body prior to the final de-ionized water rinse of stage 6. To conserve water and to obtain the maximum benefit from the water used, this rinse can be constructed and operated in a manner similar to that of stage 3. The stage 5 rinse is typically operated at ambient temperature at a pH in the range of 4 to 8, preferably 4 to 6. An inorganic acid, preferably sulfuric acid, is used to achieve the desired pH. The cans are typically sprayed from 1 to 60 seconds, preferably from 5 to 30 seconds, and more preferably for about 15 seconds.

The last stage in the can washing process, stage 6, is the de-ionized water rinse. By de-ionization, water purity as good as distilled water can be obtained. De-ionized water is tap water (city water or well water) from which all or most of the natural mineral salts (e.g., calcium, silicates, phosphates, etc.) have been removed by means of ion exchange columns. Prior to passing through the ion exchange columns, the tap water is passed through a carbon filter to remove organic and particulate matter. This stage is typically operated at a pH in the range of 3 to 5, preferably 4 to 4.5. An inorganic acid such as sulfuric acid is used to provide the desired pH. This stage is generally operated at ambient temperature and the cans are sprayed from about 1 to 60 seconds, preferably from 5 to 20 seconds and more preferably for about 10 seconds.

Following the de-ionized water rinse, the cans are conveyed through a dry off oven to remove all moisture therefrom. The temperature of the dry off oven is preferably as low as possible to dry the cans. Typically dry off oven temperatures range from 325° F. to 375° F. and the dwell time, i.e., residence time, for each can in the oven ranges from 20 seconds to 5 minutes, preferably from 30 seconds to 2 minutes and more preferably for about 1 minute. From the dry off oven the cans are conveyed along a high-speed conveyor (e.g., conveyorized transfer lines, chutes, single filers, etc.) at rates typically in excess of 1000 cans per minute to a remote location in the manufacturing facility where the cans may be coated internally, such as with a sanitary lacquer, and/or externally, such as with basecoats, printing inks and varnishes.

The inventive process, which employs the mobility enhancing composition comprising at least one wax and at least one surfactant, provides several advantages. The mobility enhancing composition provides oven temperature reduction, is dry off oven stable, and provides the advantage of improved mobility of the cans without deleteriously affecting adhesion of subsequently applied printing inks, basecoats or varnishes. Also, use of the mobility enhancing composition does not affect the food and beverage products with which the cans are filled.

Illustrating the invention are the following examples which, however, are not to be considered as limiting the invention to their details. All parts and percentages in the following examples as well as throughout the specification are by weight unless otherwise indicated.

EXAMPLES

Example 1 describes the preparation of a mobility enhancing composition of the present invention. Table 1 illustrates the improvement in mobility performance noted with the application of the composition of Example 1 to the surface of an aluminum test can versus a clean only can.

Example 2 provides the oven temperature reduction profile of the mobility enhancing composition of Example 1 versus the clean only control cans. Table 2 illustrates that the application of the composition of Example 1 not only improved mobility performance, but also produced 100% dry cans at oven temperatures 40° F. lower than those required for the clean only control cans.

Example 3 describes oven temperature stability testing of aluminum test cans to which the mobility enhancing composition of Example 1 had been applied versus test cans to which a commercial mobility enhancer had been applied. The data presented in Table 3 illustrates the oven temperature stability advantages provided with the application of the mobility enhancing composition of the invention over a commercial mobility enhancer.

Examples 4-B to 4-F describe mobility enhancing compositions of the invention comprised of varying levels of the same wax component. Example 4-A represents a clean only surface with no mobility enhancing composition applied. The data in Table 4 illustrates that the optimal wax level in the inventive mobility enhancing compositions has no deleterious effect on adhesion of a subsequently applied basecoat.

Examples 5B to 5-I describe the preparation of mobility enhancing compositions of the invention which contain various wax components. Comparative Examples 5-A and 5-J describe the preparation of mobility enhancing compositions containing a commercially available ethylene oxide/propylene copolymer and one containing no wax component, respectively. The test results reported in Table 6 illustrate that the mobility compositions of the invention applied in stage 4 of the can cleaning process provide a significant improvement in mobility performance over clean only test cans and over the commercial mobility enhancer. The data also illustrate that the mobility enhancing composition without wax does not provide improved mobility performance.

TEST METHODS:

Test cans were generally prepared as follows. Uncleaned aluminum cans obtained from a can manufacturer were cleaned in a six stage cleaning process using laboratory spray cabinets to simulate a conventional aluminum can washing process. The laboratory spray cabinets were designed by Betz Laboratories and custom built by Eddington Tool and Die Co.

The six stages are as follows:

STAGE 1: Acid pre-wash stage. Cans are sprayed with an aqueous sulfuric acid solution ( pH to 2–3) for ten seconds at 100 degrees F.

STAGE 2: Cleaning stage. Cans are sprayed with acidic cleaning solution for 60 seconds at 140 degrees F or with alkaline cleaning solution at 110 degrees F for 60 seconds.

STAGE 3: Acid rinse stage. Cans are sprayed with an aqueous sulfuric acid solution (pH of 2–3) for ten seconds at 100 degrees F.

STAGE 4: Mobility enhancer stage. Cans are sprayed with aqueous dispersions of mobility enhancing compositions as described in the following examples 1 to 5.

STAGE 5: Water rinse stage. Cans are sprayed with tap water at ambient temperature.

STAGE 6: De-ionized water rinse stage. Cans are sprayed with de-ionized water at ambient temperature.

The stage 6 de-ionized water rinse is followed by oven dry-off for 3 minutes dwell time at 302 degrees F, except for cans used in the oven stability testing procedure which is described in detail below.

INCLINE PLANE MOBILITY TEST:

The incline plane mobility test evaluates the ability of a mobility enhancing composition to reduce the co-efficient of static friction ("C.O.S.F.") using an incline plane mobility tester, custom built by PPG Industries, Inc. Test cans are prepared as described above. Three cans are selected as the cans exit the dry-off oven and are allowed to cool for three minutes at which time each can is marked with a set of reference lines commonly referred to as "looper lines".

Two "base cans" are placed on a platform of the incline plane mobility tester with the looper lines on the top side and the open ends to the right. A third can is placed on top of the base cans, open end to the left and approximately one inch from the open end of the base cans.

The platform is slowly elevated until the top can slides and strikes a horizontal surface. The angle of incline of the platform is recorded at this time. The top can is then rotated 90 degrees and the process is repeated three additional times. Each of the base cans are then rotated 180 degrees and the cycle is repeated once more. The complete procedure produces eight data points. The data is reported as the average angle of incline or as the coefficient of static friction which is the tangent of the average angle of incline.

BASE COAT ADHESION TESTING:

The base coat adhesion test evaluates whether a pretreatment will effect adhesion of subsequently applied coatings. Container base coats pose a particular adhesion problem because these coatings typically are highly pigmented and are applied directly to the cleaned aluminum can service at relatively high film weights.

Test panels are prepared as follows. Aluminum cans, which are cleaned as in the cleaning process described above, are cut open and the bottom dome of each is removed. Each can body is then flattened to form a sheet. A commercial base coat is applied to the sheet via a drawdown technique to the exterior aluminum can surface using a #10 RDS coating rod. The test sheet is anchored on a flat hard surface. An excessive amount of coating is applied near the top of the aluminum sheet and the coating rod is drawn through the coating and down the length of the sheet to provide a uniform wet coating thereon. A #10 RDS coating rod provides a base coat film weight equivalent to 180–200 milligrams per can. A commercial white container base coat, 25N18-11, available from BASF Corporation was used for the basecoat adhesion testing described herein.

Coated aluminum sheets are then cured at 385 degrees F for two minutes. After cool-down, the coated sheets are tested for adhesion using the pencil scratch hardness testing procedure in accordance with ASTM-D3363.

The pencil scratch hardness tester determines the ability of a coating to resist surface scratching which is an indication of adhesion performance. The tester is manufactured by Gardner, model number HA-3363. This tester uses constant pressure and pencil leads of various hardnesses (that is, 4B to 9H). Pencil leads are moved over the surface being tested at a fixed angle to the surface. The degree of hardness of the pencil lead, which scratches the surface, is reported as a numerical adhesion rating.

The higher the degree of hardness of the pencil lead, the higher the adhesion rating number and the better the coating adhesion performance. For example, a 4B pencil lead (softest lead) is reported at an adhesion rating of 0, while a 9H pencil lead (hardest lead) is reported as an adhesion rating of 14. The Scratch Hardness Tester rating scale is provided below. The pencil hardness values are converted into numerical values in accordance with the rating conversion scale below.

| HARDEST LEAD---------- | | | | | | | | | | | | | | | SOFTEST LEAD |
|---|---|---|---|---|---|---|---|---|---|---|---|---|---|---|---|
| Pencil Hardness | 9H | 8H | 7H | 6H | 5H | 4H | 3H | 2H | H | F | HB | B | 2B | 3B | 4B |
| Adhesion rating | 14 | 13 | 12 | 11 | 10 | 9 | 8 | 7 | 6 | 5 | 4 | 3 | 2 | 1 | 0 |

DRY-OFF OVEN TEMPERATURE STABILITY TEST:

The oven temperature stability test evaluates the tendency of a mobility enhancing composition to volatilize in the dry-off oven during extended dry times, which can occur during line stoppages. If the mobility enhancing composition volatilizes the co-efficient of static friction can increase thereby negatively effecting the mobility of the cans through the track work to remote locations in the manufacturing facility.

Test cans are prepared as described above using a six stage pilot line and placed on an oven mat to be transported into a dry-off oven set at 360 degrees F. The dwell time in the pilot line oven is typically 90 seconds during normal operation. The cans are conveyed into and stopped at the center of the dry-off oven and held there until reaching a peak metal temperature of 360 degrees F for 5 minutes. The cans are then conveyed to exit the oven. Oven temperature stability is evaluated by testing can mobility using the incline mobility test method described above.

OVEN TEMPERATURE REDUCTION:

Oven temperature reduction refers to the ability to obtain a fully dry can surface suitable for further processing using a lower dry off oven temperature. The ability to reduce the dry off oven temperature is desirable because it results in a significant energy cost savings.

Aluminum test cans are prepared on a six stage aluminum can cleaning pilot line as described above. The extent of can dryness is observed visually after cans exit the dry off oven. Percent dryness for each dry off oven temperature evaluated is reported.

EXAMPLE 1

This example describes the preparation of a mobility enhancing composition in accordance with the present invention. The mobility enhancing composition was prepared from a mixture of the following ingredients:

| INGREDIENTS | % by weight |
|---|---|
| Deionized water | 70 |
| COBRATEC TT 50 S[1] | 1 |
| PLURONIC L-101[2] | 1 |
| Hexylene Glycol | 4 |
| FOAM BAN MS-575[3] | 0.5 |
| ABEX JKB[4] | 3.5 |
| MICHEM LUBE 162[5] | 20 |

[1]Sodium salt of tolyltriazole commercially available from PMC Specialties Group Inc.
[2]Block copolymer of propylene oxide and ethylene oxide commercially available from BASF Corporation.
[3]Defoaming agent commercially available from Ultra Additives, Inc.
[4]Alkyl ether sulfate anionic surfactant commercially available from Rhone-Poulenc NA Chemicals.
[5]Carnauba wax/microcrystalline carnauba wax emulsion commercially available from Michelman, Inc.

The ingredients listed above were added sequentially under shear to a suitably equipped vessel and mixed until a homogeneous composition was obtained.

Aluminum test cans were cleaned in laboratory spray cabinets as described above using PPG DR-1369/1700 alkaline cleaner (available from PPG Industries, Inc.) and processed using the testing procedure described below. The mobility enhancing composition of Example 1 was added to stage 4 at a concentration of 2500 ppm. The pH of this solution was decreased to 3.7 using dilute sulfuric acid.

TESTING PROCEDURE:

STAGE 1-Acid Prewash ($H_2SO_4$), 10 secs. @ 100° F.

STAGE 2-Cleaner stage-PPG cleaners DR-1369/1700, 60 secs. @ 110° F.

STAGE 3-Acid Rinse ($H_2SO_4$) 10 sec. @ 100° F.

STAGE 4-Mobility enhancing composition applied (the control, "CTL", used tap water only)

STAGE 5-Tap $H_2O$ Rinse

STAGE 6-DI $H_2O$ Rinse

STAGE 7-Oven Dry

STAGE 8-Incline Plane Angle Mobility Measurements

The aluminum test cans prepared as described above were evaluated for mobility performance using the above-described Incline Mobility Test versus control cans to which no mobility enhancing composition was applied (designated as "CTL" in the following examples). Test results are provided in the following Table 1.

TABLE 1

MOBILITY PERFORMANCE RESULTS

| EXAMPLE | Conc. ppm | Incline Mobility | C.O.S.F. |
|---|---|---|---|
| CTL | — | 54 +/− 2.4 | 1.38 |
| EXAMPLE 1 | 2500 | 25 +/− 1.0 | 0.47 |

The mobility performance test results provided in Table 1 illustrate the improvement in mobility performance noted with the application of a mobility enhancing composition of the present invention to aluminum can surfaces over cans to which no mobility enhancing composition has been applied.

EXAMPLE 2

OVEN TEMPERATURE REDUCTION PROPERTIES

Additional oven temperature reduction performance testing was evaluated for the mobility enhancing composition of Example 1 versus control cans to which no mobility enhancing composition was applied (CTL) using the Oven Temperature Reduction Test procedure described above. The oven temperature reduction properties of Example 1 were tested on a six stage aluminum can cleaning pilot line using PCL-452 acid cleaner system available from PPG Industries, Inc. The cans were treated with 1000–2000 ppms of the mobility enhancing composition of Example 1 in stage 4, with a bath pH range of 3.5 to 4.0. Test results are reported in the following Table 2.

TABLE 2

OVEN TEMPERATURE REDUCTION PROPERTIES

| EXAMPLE | Concentration (ppm) | Oven Temperature (° F.) | % dry | Incline plane angle (avg.) | C.O.S.F. |
|---|---|---|---|---|---|
| Clean Only | 0 | 400 | 100 | 55.8 +/− 2.0 | 1.47 |
| (CTL) | 0 | 390 | 83 | 56.4 +/− 1.7 | 1.5 |
| | 0 | 380 | 17 | 55.4 +/− 1.7 | 1.45 |
| Example 1 | 1000 | 380 | 83 | 28.6 +/− 2.7 | 0.55 |
| | 1000 | 370 | 83 | 28.6 +/− 2.3 | 0.55 |
| | 2000 | 370 | 100 | 24.0 +/− 1.6 | 0.45 |
| | 2000 | 360 | 100 | 22.6 +/− 0.9 | 0.42 |
| | 2000 | 350 | 67 | 21.6 +/− 0.9 | 0.40 |

The data in Table 2 illustrate that the application of 2000 ppm of the mobility enhancing composition of Example 1 produced 100% dry cans at oven temperatures 40° F. lower than those required for the control (CTL) to which no mobility enhancing compositions was applied. Also, the results illustrate that the composition of Example 1 only provided oven temperature reduction, but excellent mobility as well.

EXAMPLE 3

OVEN TEMPERATURE STABILITY

Aluminum test cans were prepared as described above, with the mobility enhancing composition of Example 1 and a commercial mobility enhancing composition PPG DR-1597 available from PPG Industries, Inc., applied in stage 4 at a concentration of 2000 parts per million. These cans were tested for oven temperature stability using the testing procedure described above. Test results are reported in the following Table 3.

TABLE 3

OVEN TEMPERATURE STABILITY

| EXAMPLE | ppm | ° F. | % dry | Ave. Incline Plane Angle | C.O.S.F |
|---|---|---|---|---|---|
| Example 1 No line stop | 2000 | 360 | 100 | 22.6 +/− 0.9 | 0.42 |
| Example 1 5 min. line stop | 2000 | 360 | 100 | 23.5 +/− 0.9 | 0.43 |
| DR-1597 (Comparative) No line stop | 2000 | 360 | 100 | 38.5 +/− 1.4 | 0.80 |
| DR-1597 (Comparative) 5 min. line stop | 2000 | 360 | 100 | 46 +/− 1.5 | 1.04 |

Test results reported in Table 3 above illustrate the oven temperature stability profile of the mobility enhancing composition of Example 1 versus PPG DR-1597, a commercial mobility enhancing composition. The data in Table 3 indicate that the mobility performance of DR-1597 was reduced by 16% after 5 minutes in the pilot line oven, while the mobility performance of the composition of Example did not change.

EXAMPLE 4

BASECOAT ADHESION

In accordance with the basecoat adhesion testing procedure described above, basecoat adhesion was evaluated for the following Examples 4-A through 4-F wherein various levels of the mobility enhancing composition of Example 1 were applied to aluminum test cans in stage 4, with a pH range of 4.0 to 4.6. Test results are reported in the following Table 4.

TABLE 4

BASECOAT ADHESION TESTING RESULTS

| EXAMPLE | Concentration mobility enhancer of Example 1 (ppm measured) | Incline Plane Mobility | C.O.S.F. | Basecoat Adhesion* |
|---|---|---|---|---|
| 4-A (comparative) | 0 (CTL) | 52.3 | 1.29 | 11 |
| 4-B | 600 | 33.6 | 0.66 | 11 |
| 4-C | 1250 | 25.1 | 0.47 | 11 |
| 4-D | 1650 | 22.1 | 0.41 | 11 |
| 4-E | 2000 | 19.5 | 0.35 | 11 |
| 4-F | 2000 | 17.3 | 0.31 | 11 |

*The larger the adhesion number, the greater the adhesion properties.

The results reported in Table 4 illustrate that basecoat adhesion is not adversely affected with the application of levels of the inventive mobility enhancing composition of Example 1 which provide optimal mobility properties.

EXAMPLES 5-A THROUGH 5-J

Examples 5-A through 5-I describe the preparation of mobility enhancing compositions of the present invention which contain various waxes. Comparative Example 5-J describes the preparation of an analogous composition that contains no wax. The examples were prepared from a mixture of the following ingredients. Amounts listed are percentages based on total weight of the composition.

| Ingredients | 5-A* % | 5-B % | 5-C % | 5-D % | 5-E % | 5-F % | 5-G % | 5-H % | 5-I % | 5-J* % |
|---|---|---|---|---|---|---|---|---|---|---|
| Deionized water | 70 | 70 | 70 | 70 | 70 | 70 | 70 | 70 | 70 | 70 |
| COBRATEC TT 50S | 1 | 1 | 1 | 1 | 1 | 1 | 1 | 1 | 1 | 1 |
| PLURONIC L-101 | 1 | 1 | 1 | 1 | 1 | 1 | 1 | 1 | 1 | 1 |
| Hexylene glycol | 4 | 4 | 4 | 4 | 4 | 4 | 4 | 4 | 4 | 4 |
| FOAM BAN MS-575 | 0.5 | 0.5 | 0.5 | 0.5 | 0.5 | 0.5 | 0.5 | 0.5 | 0.5 | 0.5 |
| ABEX JKB | 3.5 | 3.5 | 3.5 | 3.5 | 3.5 | 3.5 | 3.5 | 3.5 | 3.5 | 3.5 |
| PPG DR-1597[1] | 20 | — | — | — | — | — | — | — | — | — |
| MICHEM LUBE 162 | — | 20 | — | — | — | — | — | — | — | — |
| MICHEM LUBE 156[2] | — | — | 20 | — | — | — | — | — | — | — |
| Michelman EMULSION 24925[3] | — | — | — | 20 | — | — | — | — | — | — |
| MICHEM LUBE 743[4] | — | — | — | — | 20 | — | — | — | — | — |
| CHEMCOR 392CO[5] | — | — | — | — | — | 20 | — | — | — | — |
| MICHEM LUBE 723[6] | — | — | — | — | — | — | 20 | — | — | — |
| CHEMCOR EMULSION 12[7] | — | — | — | — | — | — | — | 20 | — | — |
| MICHEM LUBE 182[8] | — | — | — | — | — | — | — | — | 20 | — |

*Comparative examples
[1]Mobility enchancer of ethylene oxide/propylene oxide copolymer, available from PPG Industries, Inc.
[2]Carnauba wax emulsion, available from Michelman, Inc.
[3]Nonionic polyethylene emulsion available from Michelman, Inc.
[4]Paraffin wax emulsion available form Michelman, Inc.
[5]Cationic polyethylene emulsion available from Chemcor Inc.
[6]Paraffin wax emulsion available from Michelman, Inc.
[7]Co-emulsion of polyethylene and paraffin wax available from Chemcor Inc.
[8]Anionic co-emulsion of carnauba wax and paraffin wax available from Michelman Inc.

A base formula for the mobility enhancer performance testing was prepared. The waxes were added under agitation to this base formula. Aluminum test cans were prepared as described above and mobility performance was evaluated in accordance with the testing procedure described above.

EXAMPLE 6

Comparative Example 6-A represents the clean only test cans, rinsed in stage 4 with water only. Comparative Examples 6-B and 6-C contain the commercial mobility enhancer, PPG DR-1597, applied in stage 4 and stage 6, respectively. Comparative Example 6-L represents test cans to which the mobility enhancing composition without wax additive was applied (CTL). Examples 6-D through 6-K represent test cans to which the various mobility enhancing compositions of Example 5-B through 5-J were applied in stage 4. Test results are provided in the following Table 6.

TABLE 6

| Example | Description | Mobility Enhancer Concentration | Incline Plane Mobility | C.O.S.F. |
|---|---|---|---|---|
| 6-A (comparative) | Clean only can (CTL) | --0-- | 58.1 | 1.6 |
| 6-B (comparative) | Example 5-A, applied stage 4 | 2000 ppm | 53.6 | 1.4 |
| 6-C (comparative) | Example 5-A, applied stage 6 | 2000 ppm | 35.5 | 0.71 |
| 6-D | Example 5-B, applied stage 4 | 2000 ppm | 28.3 | 0.53 |
| 6-E | Example 5-C, applied stage 4 | 2000 ppm | 28.1 | 0.53 |
| 6-F | Example 5-D, Applied stage 4 | 2000 ppm | 17.3 | 0.31 |
| 6-G | Example 5-E, applied stage 4 | 3000 ppm | 31.9 | 0.62 |
| 6-H | Example 5-F, applied stage 4 | 3000 ppm | 37.4 | 0.76 |
| 6-I | Example 5-G, applied stage 4 | 3000 ppm | 33.8 | 0.67 |
| 6-J | Example 5-H, applied stage 4 | 2000 ppm | 30.3 | 0.58 |
| 6-K | Example 5-I, applied stage 4 | 3000 ppm | 32.8 | 0.64 |
| 6-L (comparative) | Example 5-J | --0-- | 57.5 | 1.57 |

The test results reported in Table 6 illustrate that the mobility enhancing compositions of the invention applied in stage 4 of the can cleaning process provide a significant improvement in mobility performance over cleaned only controls or over the commercial mobility enhancer, PPG-DR-1597 when applied in stage 4. (PPG DR-1597 only provides C.O.S.F. less than 1 with the less desirable stage 6 application.) The data also illustrates that the mobility enhancing composition without the wax additive does not provide improved mobility performance.

What is claimed is:

1. A process for cleaning and applying a mobility enhancer to a metal container, said process comprising the following steps:

(a) contacting said container with an aqueous acidic prewashing solution;

(b) contacting said container with an aqueous acidic or alkaline cleaning solution;

(c) rinsing said container with an aqueous acidic composition;

(d) rinsing said container with a mobility enhancing composition, said mobility enhancing composition consisting essentially of an acidic aqueous dispersion of the following components in the dispersed phase:

(i) at least one wax selected from the group consisting of a petroleum wax, a mineral wax and a vegetable wax; and (ii) a surfactant;

in an amount sufficient to decrease the coefficient of static friction on the outside surface of the container to 1 or less, and to provide a substantially water break free surface;

(e) rinsing said container with tap water and/or de-ionized water;

(f) drying said container; and (g) conveying said container along a conveyor or trackwork.

2. The process of claim 1 wherein the wax component (i) is present in the aqueous acidic dispersion in an amount of from 5 parts per million to 10,000 parts per million based on total weight of the aqueous acidic dispersion.

3. The process of claim 1 wherein the surfactant component (ii) is present in the aqueous acidic dispersion in an amount of from 10 parts per million to 2000 parts per million based on total weight of the aqueous acidic dispersion.

4. The process of claim 1 wherein the wax is selected from the group consisting of carnauba wax, microcrystalline carnauba wax, paraffin wax and mixtures thereof.

5. The process of claim 4 wherein the wax component (i) comprises a mixture of carnauba wax and microcrystalline carnauba wax.

6. The process of claim 4 wherein the wax component (i) comprises a mixture of carnauba wax and paraffin wax.

7. The process of claim 4 wherein the wax component (i) is carnauba wax.

8. The process of claim 4 wherein the wax component (i) is paraffin wax.

9. The process of claim 1 wherein the surfactant is selected from the group consisting of non-ionic surfactants and anionic surfactants, cationic surfactants and mixtures thereof.

10. The process of claim 1 wherein the metal container is an aluminum can.

11. A process for cleaning and applying a mobility enhancer to a metal container, said process comprising the following steps:

(a) contacting said container with an aqueous acidic prewashing solution;

(b) contacting said container with an aqueous acidic or alkaline cleaning solution;

(c) rinsing said container with an aqueous acidic composition;

(d) contacting said container with a conditioning rinse composition or a conversion coating composition, said conditioning rinse composition or conversion coating composition consisting essentially of a mobility enhancing composition, said mobility enhancing composition consisting essentially of an acidic aqueous dispersion of the following components in the dispersed phase:

(i) at least one wax selected from the group consisting of a petroleum wax, a mineral wax and a vegetable wax; and (ii) at least one surfactant;

in an amount sufficient to decrease the coefficient of static friction on the outside surface of the container to 1 or less, and to provide a substantially water break free surface;

(e) rinsing said container with an aqueous acidic composition;

(f) rinsing said container with de-ionized water;

(g) drying said container; and (h) conveying said container along a conveyor or trackwork.

12. The process of claim 11 wherein the wax component (i) is present in the conditioning rinse composition or conversion coating composition in an amount of from 5 parts per million to 2000 parts per million based on total weight of the conditioning rinse composition or conversion coating composition.

13. The process of claim 11 wherein the surfactant component (ii) is present in the conditioning rinse composition or conversion coating composition in an amount of from 5 parts per million to 2000 parts per million based on total weight of the conditioning rinse composition or the conversion coating composition.

14. The process of claim 11 wherein the wax is selected from the group consisting of carnauba wax, microcrystalline carnauba wax, paraffin wax and mixtures thereof.

15. The process of claim 14 wherein the wax component (i) comprises a mixture of carnauba wax and microcrystalline carnauba wax.

16. The process of claim 14 wherein the wax component (i) comprises a mixture of carnauba wax and paraffin wax.

17. The process of claim 14 wherein the wax component (i) is carnauba wax.

18. The process of claim 14 wherein the wax component (i) is paraffin wax.

19. The process of claim 11 wherein the surfactant is selected from the group consisting of non-ionic surfactants, anionic surfactants cationic surfactants, and mixtures thereof.

20. The process of claim 11 wherein the metal container is an aluminum can.

21. A process for cleaning and applying a mobility enhancer to a metal container, said process comprising the following steps:

(a) contacting said container with an aqueous acidic prewashing solution;

(b) contacting said container with an aqueous acidic or alkaline cleaning solution;

(c) rinsing said container with an aqueous acidic composition;

(d) contacting said container with a conditioning rinse composition or a conversion coating composition;

(e) rinsing said container with an aqueous acidic dispersion consisting essentially of a mobility enhancer consisting essentially of the following components in the dispersed phase:

(i) at least one wax selected from the group consisting of a petroleum wax, a mineral wax and a vegetable wax; and (ii) at least one surfactant;

in an amount sufficient to decrease the coefficient of static friction on the outside surface of the container to 1 or less, and to provide a substantially water break free surface;

(f) rinsing said container with tap water and/or de-ionized water;

(g) drying said container; and (h) conveying said container along a conveyor or trackwork.

22. The process of claim 21 wherein the wax component (i) is present in the aqueous acidic dispersion in an amount of from 5 parts per million to 10,000 parts per million based on total weight of the aqueous acidic dispersion.

23. The process of claim 21 wherein the surfactant component (ii) is present in the aqueous acidic dispersion in an amount of from 10 parts per million to 2000 parts per million based on total weight of the aqueous acidic dispersion.

24. The process of claim 21 wherein the wax is selected from the group consisting of carnauba wax, microcrystalline carnauba wax, paraffin wax and mixtures thereof.

25. The process of claim 21 wherein the wax component (i) comprises a mixture of carnauba wax and microcrystalline carnauba wax.

26. The process of claim 21 wherein the wax component (i) comprises a mixture of carnauba wax and paraffin wax.

27. The process of claim 21 wherein the wax component (i) is carnauba wax.

28. The process of claim 21 wherein the wax component (i) is paraffin wax.

29. The process of claim 21 wherein the surfactant is selected from the group consisting of non-ionic surfactants and anionic surfactants, cationic surfactants, and mixtures thereof.

30. The process of claim 21 wherein the metal container is an aluminum can.

31. A process for cleaning and applying a mobility enhancer to a metal container, said process comprising the following steps:

(a) contacting said container with an aqueous acidic prewashing solution;

(b) contacting said container with an aqueous acidic or alkaline cleaning solution;

(c) rinsing said container with an aqueous acidic composition;

(d) contacting said container with a conditioning rinse composition or a conversion coating composition;

(e) rinsing said container with an acidic aqueous dispersion consisting essentially of the following components in the dispersed phase in tap water and/or de-ionized water:

(i) at least one wax selected from the group consisting of petroleum waxes, mineral waxes and vegetable waxes; and (ii) at least one surfactant, in an amount sufficient to decrease the coefficient of static friction on the outside surface of the container to 1 or less, and to provide a substantially water bread free surface;

(f) drying said container; and (g) conveying said container along a conveyor or trackwork.

32. The process of claim 31 wherein the wax component (i) is present in the aqueous dispersion in an amount of from 5 parts per million to 5,000 parts per million based on total weight of the aqueous dispersion.

33. The process of claim 31 wherein the surfactant component (ii) is present in the aqueous dispersion in an amount of from 10 parts per million to 2,000 parts per million based on total weight of the aqueous dispersion.

34. The process of claim 31 wherein the wax is selected from the group consisting of carnauba wax, microcrystalline carnauba wax, paraffin wax and mixtures thereof.

35. The process of claim 34 wherein the wax component (i) comprises a mixture of carnauba wax and microcrystalline carnauba wax.

36. The process of claim 34 wherein the wax component (i) comprises a mixture of carnauba wax and paraffin wax.

37. The process of claim 34 wherein the wax component (i) is carnauba wax.

38. The process of claim 34 wherein the wax component (i) is paraffin wax.

39. The process of claim 31 wherein the surfactant component (ii) is selected from the group consisting of non-ionic surfactants and anionic surfactants and mixtures thereof.

40. The process of claim 31 wherein the metal container is an aluminum can.

* * * * *